US009807835B1

(12) United States Patent
Janos et al.

(10) Patent No.: US 9,807,835 B1
(45) Date of Patent: Oct. 31, 2017

(54) CIRCUITRY FOR WARM DIM LIGHTING

(71) Applicant: The L.D. Kichler Co., Cleveland, OH (US)

(72) Inventors: Joseph John Janos, Phoenix, AZ (US); Thomas Joseph Tyson, Cleveland, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 15/193,326

(22) Filed: Jun. 27, 2016

Related U.S. Application Data

(63) Continuation of application No. 14/816,325, filed on Aug. 3, 2015, now Pat. No. 9,380,671.

(60) Provisional application No. 62/033,171, filed on Aug. 5, 2014.

(51) Int. Cl.

| | |
|---|---|
| ***H05B 33/08*** | (2006.01) |
| ***F21V 9/16*** | (2006.01) |
| ***F21K 9/64*** | (2016.01) |
| ***H05B 37/02*** | (2006.01) |
| *F21Y 115/10* | (2016.01) |
| *F21K 9/232* | (2016.01) |
| *F21K 9/235* | (2016.01) |
| *F21K 9/237* | (2016.01) |

(52) U.S. Cl.
CPC ..... *H05B 33/0845* (2013.01); *F21K 9/64* (2016.08); *F21V 9/16* (2013.01); *H05B 33/0884* (2013.01); *H05B 37/0272* (2013.01); *F21K 9/232* (2016.08); *F21K 9/235* (2016.08); *F21K 9/237* (2016.08); *F21Y 2115/10* (2016.08)

(58) Field of Classification Search
CPC ..... H05B 33/0845; H05B 33/0884; H05B 33/0866; F21K 9/64; F21K 9/56; F21K 9/23; F21Y 2101/00; F21Y 2115/10
USPC ..... 315/149, 291, 294, 307, 312; 362/231, 362/249.02, 264, 294, 373
See application file for complete search history.

(56) References Cited

U.S. PATENT DOCUMENTS

| | | | | |
|---|---|---|---|---|
| 7,618,157 | B1 * | 11/2009 | Galvez | F21V 3/0481 362/218 |
| 8,203,260 | B2 * | 6/2012 | Li | H05B 33/086 313/502 |
| 8,322,896 | B2 * | 12/2012 | Falicoff | F21V 3/0481 313/46 |

(Continued)

*Primary Examiner* — Haissa Philogene
(74) *Attorney, Agent, or Firm* — Calfee, Halter & Griwsold, LLP

(57) ABSTRACT

A method of dimming an LED luminaire and a dimmable LED luminaire includes two pluralities of LEDs. The first plurality emits electromagnetic radiation at a first frequency to react with a remote phosphor and provide a phosphor illumination. The second plurality of LEDs are phosphor LEDs that emit phosphor electromagnetic radiation at a second frequency to react with the remote phosphor and provide double-phosphor illumination. The phosphors and LEDs are configured to produce specific color points when the LEDs are at full power and at full dim. When the luminaire receives a dimming signal, the first plurality of LEDs dim the phosphor illumination over a majority of the luminaire's illumination range, but the second plurality of LEDs continue to receive constant current and provide undimmed double-phosphor illumination over the majority of the luminaire's illumination range.

20 Claims, 8 Drawing Sheets

(56) References Cited

U.S. PATENT DOCUMENTS

| | | | | |
|---|---|---|---|---|
| 8,360,607 | B2 * | 1/2013 | Bretschneider | F21V 7/22 362/218 |
| 8,921,876 | B2 * | 12/2014 | van de Ven | F21K 9/232 257/98 |
| 8,936,997 | B2 * | 1/2015 | Jagt | C08K 3/0008 257/98 |
| 9,380,671 | B1 * | 6/2016 | Janos | H05B 33/0884 |
| 2010/0289044 | A1 * | 11/2010 | Krames | C09K 11/08 257/98 |

* cited by examiner

CIRCUITRY FOR WARM DIM LIGHTING

CROSS REFERENCE TO RELATED APPLICATIONS

This application is a continuation of U.S. patent application Ser. No. 14/816,325 filed Aug. 3, 2015, which claims priority to, and any other benefit of, U.S. Provisional Patent Application Ser. No. 62/033,171 filed Aug. 5, 2014, and entitled "Warm Dim Remote Phosphor Luminaire," the entire disclosures of which are incorporated herein by reference.

TECHNICAL FIELD

The present invention relates generally to circuitry for LED luminaires, and more particularly to circuitry for providing a warm dim.

BACKGROUND OF THE INVENTION

It is common for luminaires (i.e., lighting devices) to be connected to a dimming switch or control that allows a user to lower the light level of the luminaire. Typical incandescent light sources provide light by heating a metal filament. When an incandescent light source is dimmed, whether by lowering the source voltage or by altering the phase or duty cycle of the power signal, not only does the brightness of the light decrease, but the light changes to a warmer (redder) color as the temperature of the filament decreases. The correlation between change in color and temperature is typically approximated within a chromaticity space by a black body curve (i.e., Planckian locus).

Solid state luminaires, such as LED lights, do not produce light by heating a filament. When the power source of an LED light is diminished, the brightness of the LED decreases but the color of the LED does not appreciably change.

SUMMARY

Exemplary methods of dimming a luminaire includes providing electrical power to a first plurality of LEDs emitting electromagnetic radiation at a first set of one or more frequencies to a remote phosphor to provide phosphor illumination via the remote phosphor and providing electrical power to a second plurality of LEDs, the second plurality of LEDs being phosphor LEDs emitting phosphor electromagnetic radiation at a second set of one or more frequencies that are different than the first set one or more frequencies to the remote phosphor to provide double-phosphor illumination via the remote phosphor. Responsive to receiving a signal indicating that illumination of the luminaire is to be dimmed, the first plurality of LEDs are dimmed to dim the phosphor illumination via the remote phosphor over a majority of the luminaire's illumination range, while at the same time constant current (or another signal that causes unvarying illumination) is provided to the second plurality of LEDs to provide undimmed double-phosphor illumination via the remote phosphor over the majority of the luminaire's illumination range.

Exemplary luminaires include a remote phosphor, a first plurality of LEDs spaced from the remote phosphor and emitting electromagnetic radiation at a first set of one or more frequencies to the remote phosphor to provide phosphor illumination via the remote phosphor, a second plurality of LEDs spaced from the remote phosphor, the second plurality of LEDs being phosphor LEDs emitting phosphor electromagnetic radiation at a second set of one or more frequencies that are different than the first set one or more frequencies to the remote phosphor to provide double-phosphor illumination via the remote phosphor, and a power supply providing electrical power to the first and second plurality of LEDs. The power supply, responsive to receiving a signal indicating that illumination via the remote phosphor is to be dimmed, alters the electrical power to the first plurality of LEDs to dim the phosphor illumination via the remote phosphor over an illumination range of at least 75% to 25%, while at the same time providing constant current to (or another signal that causes unvarying illumination from) the second plurality of LEDs to provide undimmed double-phosphor illumination via the remote phosphor over the illumination range of at least 75% to 25%.

BRIEF DESCRIPTION OF THE DRAWINGS

These and other features and advantages of the present invention will become better understood with regard to the following description and accompanying drawings in which.

DETAILED DESCRIPTION

As will be described in detail, a method of dimming an LED luminaire and a dimmable LED luminaire includes two pluralities of LEDs. The first plurality emits electromagnetic radiation at a first frequency to react with a remote phosphor and provide a phosphor illumination. The second plurality of LEDs are phosphor LEDs that emit phosphor electromagnetic radiation at a second frequency to react with the remote phosphor and provide double-phosphor illumination. The phosphors and LEDs are configured to produce specific color points when the LEDs are at full power and at full dim. When the luminaire receives a dimming signal, the first plurality of LEDs dim the phosphor illumination over a majority of the luminaire's illumination range, but the second plurality of LEDs continue to receive constant current and provide undimmed double-phosphor illumination over the majority of the luminaire's illumination range.

The terms "phosphor illumination" and "double-phosphor illumination" describe a mixture of wavelengths of light that together, when perceived by a human eye, create a specific color point. When electromagnetic radiation (e.g., light) reaches a phosphor material, some of the radiation passes through the phosphor unchanged and some is converted to a different wavelength. When a single phosphor is used to create phosphor illumination from an LED, the light output includes a mixture of unaltered light from the LED and phosphor-converted light. When two phosphors are used to create double-phosphor illumination from an LED, the light output includes a mix of unaltered light from the LED, light altered only by the first phosphor, light altered only by the second phosphor, and light altered by both phosphors.

Figure 1:
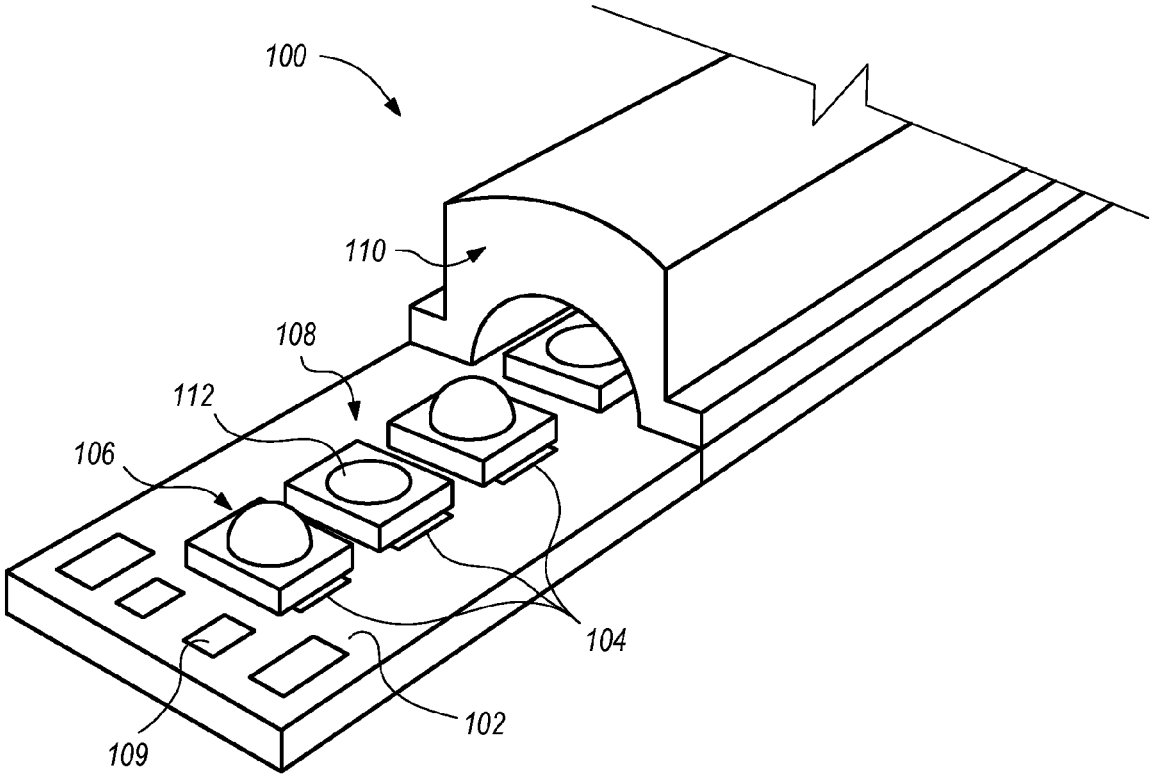
FIG. 1 is an isometric view of an exemplary embodiment of an elongated LED luminaire.

FIG. 1 illustrates an exemplary embodiment of an elongate luminaire 100. The luminaire 100 includes an elongate base 102. In some embodiments the base 102 includes a printed circuit board, heat sink, and/or substrate. Various components of the circuitry are described later in detail. The base 102 also includes electrical connections 104 for connecting one or more LEDs, for example LEDs 106 and 108, to a power source (not shown). In some embodiments the base 102 includes solder pads 109 for connecting a power source (not shown) to the luminaire 100.

The luminaire 100 also includes a translucent remote phosphor 110, illustrated as partially removed in FIG. 1. The remote phosphor 110 is positioned over the base 102 so as to form a volume between the base 102 and the remote phosphor 110. The cross-section of volume formed between base 102 and remote phosphor 110 may have any suitable shape, such as a hemispheric or rectangular shape. In some embodiments the remote phosphor 110 is formed from a polymer extrusion. In some embodiments the remote phosphor 110 is hermitically bonded to the base 102. In some embodiments the remote phosphor 110 is removable from the base 102 and attachable to the base 102 by fastener, joint, or the like.

The remote phosphor 110 includes a phosphor material that reacts with electromagnetic radiation from LEDs 106 and 108 to create phosphor illumination. In some embodiments the phosphor material is embedded within the remote phosphor 110. In some embodiments the phosphor material is deposited as a layer on the inside surface of remote phosphor 110. The phosphor material of remote phosphor 110 may be of any suitable thickness or density, and any suitable composition. Exemplary phosphors are commercially available from, for example, Intematix Corporation or PhosphorTech Corporation.

The luminaire 100 includes two different pluralities of LEDs. In one embodiment each of the first plurality of LEDs, including LED 106, is a royal blue LED configured to emit light at wavelengths near 455 nm. One exemplary royal blue LED that could be used is Nichia Corporation's model no. NF2C757DRT blue LED. While a tolerance of 455±2.5 nm is preferred, the composition of the remote phosphor 112 may allow for more significant variations to produce a desired final color temperature and CRI (Color rendering Index) or CQS (Color Quality Scale) for the phosphor illumination.

In one embodiment each of the second plurality of LEDs, for example LED 108, is a phosphor LED. In phosphor LED 108, the light source is directly covered by a phosphor 112 so as to emit phosphor electromagnetic radiation. In one embodiment the phosphor 112 is embedded within a silicone resin. In one embodiment, the phosphor LED 108, with its respective phosphor 112, is configured to emit warm white light near 2200-2400K. In one embodiment the phosphor LED 108 is configured to emit warm white light near 2000-2700K. In one embodiment the light source of LED 108 is an amber or deep red LED. An exemplary warm white phosphor LED, having an amber LED with phosphor directly over the LED in a silicon resin, is Nichia Corporation's model no. NF2L757DRT. Warm white phosphor illumination from LED 108 reacts with the remote phosphor 110 to produce double-phosphor illumination.

The two different pluralities of LEDs, for example blue LED 106 and warm white phosphor LED 108, may be arranged in any suitable pattern or order to create a homogenous light output. In one embodiment, all the LEDs are arranged in a single column and the LEDs alternate between blue and warm white phosphor LEDs. In one embodiment the LEDs are arranged in two or more columns. Every other column may contain all LEDs of one color, or each row of the two or more columns may alternate colors so that each row is a single color. In one embodiment the rows and columns alternate so as to form a checkerboard pattern.

When power is supplied to both the blue and warm white phosphor LEDs, 106 and 108 respectively, the electromagnetic radiation from the blue LED and the phosphor electromagnetic radiation from the warm white phosphor LEDs mixes in the volume between the base 102 and remote phosphor 110. The mixture of electromagnetic radiation reacts with the remote phosphor 110 to produce a final light output that radiates from the remote phosphor 110 of the luminaire 100. The final light output thus includes at least six wavelengths of light: unconverted blue light from the blue LEDs 106, blue light converted by the remote phosphor 110, unconverted amber or red light from the warm white phosphor LEDs 108, amber or red light converted only by the LED phosphor 112, amber or red light converted only be the remote phosphor 110, and amber or red light converted both by the LED phosphor 112 and the remote phosphor 110. In this way, the final light output includes a mixture of single-phosphor illumination and double-phosphor illumination. In some embodiments, a majority of the LED light remains unaltered by the phosphor(s). Even so, because phosphor does not emit as much energy as it absorbs, there is a loss of luminous efficiency compared to standard single-phosphor luminaires in order to achieve the desired color-temperature output.

In some embodiments, the luminaire includes a third color LED to improve the total light output color point and CRI. In one embodiment the third color LED is a red LED without an LED phosphor (i.e., not phosphor converted). In one embodiment the third color LED is a lime LED, which may be phosphor converted using, for example, Lumileds' PC Lime LED, or may not be phosphor converted. In one embodiment the third color LED includes its own power and control circuitry, similar to those described below for the blue and warm white LEDs. In one embodiment the third color LED uses the same constant-current or constant-voltage power and control circuitry as the warm white LEDs described below.

Figure 2:
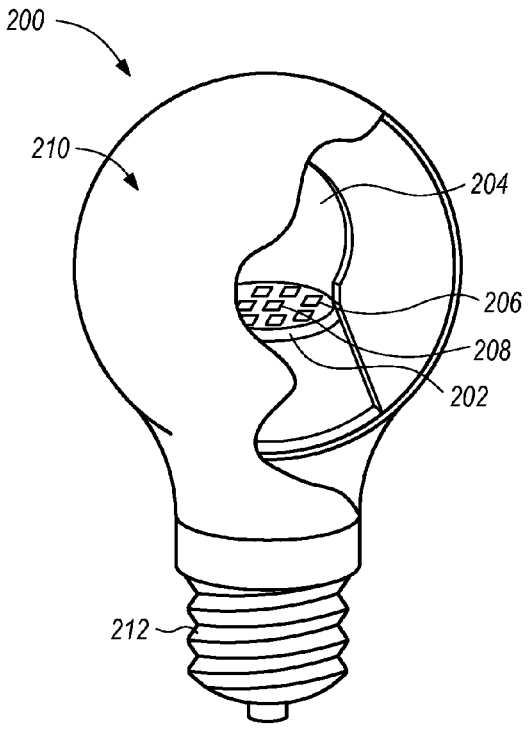
FIG. 2 is an isometric view of an exemplary embodiment of an A19-bulb LED luminaire.

FIG. 2 illustrates an exemplary A19-bulb luminaire 200 utilizing the same two-color, two-phosphor design described above. Luminaire 200 has the shape of a standard A19 bulb. Luminaire 200 includes a base 202 enclosed by a remote phosphor 204, the remote phosphor 204 having a phosphor material embedded within or deposited upon the remote phosphor 204. In some embodiments the remote phosphor 204 has a globe or bulb shape.

Two pluralities of LEDs are mounted on the base 202. Each of a first plurality of LEDs, such as LED 206 is a royal blue LED. Each of a second plurality of LEDs, such as LED 208, is a warm white phosphor LED. The LEDs of exemplary luminaire 200 are arranged in a concentric circle pattern, with each circle having a different color LED. The LEDs may be arranged in any other suitable pattern. The base 202, LEDs, and remote phosphor 204 of exemplary luminaire 200 are all enclosed within a bulb 210 made of glass or polymer material. The LEDs are electrically connected, through the base 202, to an Edison screw 212 for connecting the luminaire 200 to a power socket.

Figure 3:
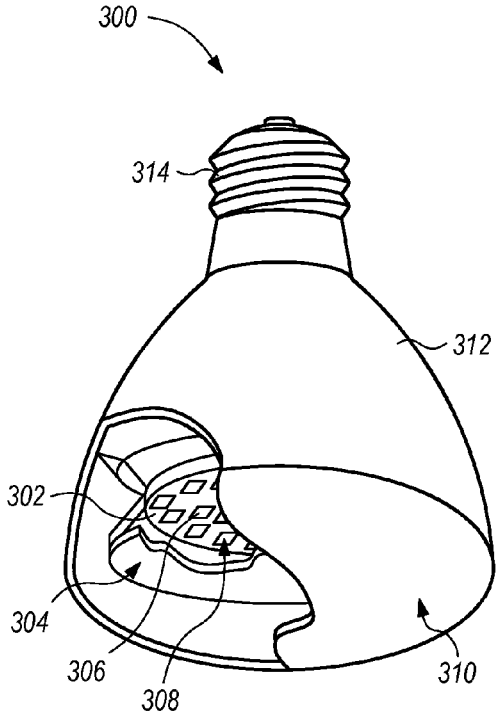
FIG. 3 is an isometric view of an exemplary embodiment of a parabolic aluminum reflector LED luminaire.

FIG. 3 illustrates an exemplary aluminum reflector luminaire 300 utilizing the same two-color, two-phosphor design described above. Luminaire 300 includes a base 302 enclosed by a remote phosphor 304, the remote phosphor 304 having a phosphor material embedded within or disposed upon the remote phosphor 304. In some embodiments the remote phosphor 304 has a conical-frustum shape. In some embodiments the remote phosphor 304 has a disc shape and is disposed on a conical-frustum shaped reflector, creating a light-mixing chamber that defines the light beam angle and enhances efficiency and color over the angle.

Two pluralities of LEDs are mounted on the base 302. Each of a first plurality of LEDs, such as LED 306 is a royal blue LED. Each of a second plurality of LEDs, such as LED 308, is a warm white phosphor LED. The LEDs of exemplary luminaire 300 are arranged in a concentric circle pattern, with each circle having a different color LED. The LEDs may be arranged in any other suitable pattern. The base 302, LEDs, and remote phosphor 304 of exemplary luminaire 300 are all enclosed within a glass diffuser 308 and a housing 312. In some embodiments the housing 312 is a parabolic aluminum reflector, and in some embodiments the housing 312 is a bulge reflector. The LEDs are electrically connected, through the base 302, to Edison screw 314, or any other suitable connector for connecting the luminaire 300 to a power socket.

Figure 4:
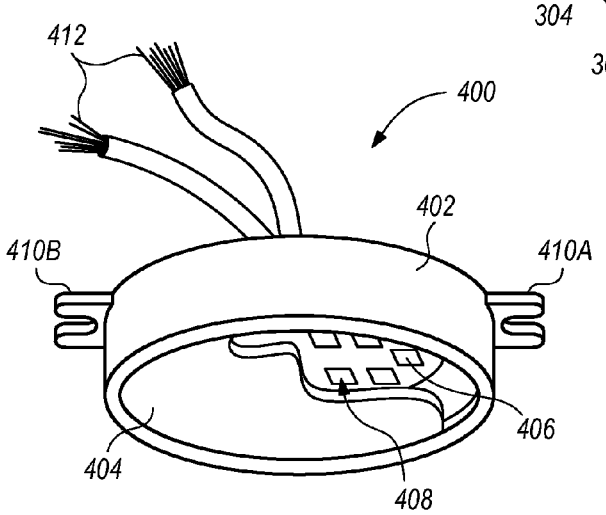
FIG. 4 is an isometric view of an exemplary embodiment of a modular light engine LED luminaire.

FIG. 4 illustrates an exemplary modular light engine 400 utilizing the same two-color, two-phosphor design described above. Modular light engine 400 includes a cylindrical-shaped base 402 enclosed on the top by a remote phosphor 404. The remote phosphor 404 includes a phosphor material embedded within or deposited upon it. The remote phosphor 404 may be flat or shaped to produce difference light distribution patterns.

Two pluralities of LEDs are mounted on and inside the base 402. Each of a first plurality of LEDs, such as LED 406, is a royal blue LED. Each of a second plurality of LEDs, such as LED 408, is a warm white phosphor LED. The LEDs of exemplary modular light engine 400 are arranged in a concentric circle pattern, with each circle having a different color LED. The LEDs may be arranged in any other suitable pattern. In some embodiments the base 402 includes one or more mounting members 410A and 410B for connecting the modular light engine 400 inside a decorative luminaire, which may then be mounted to a wall or ceiling. The LEDs are electrically connected, through the base 402, to power connection cables 412 for connecting the luminaire 400 to a power source.

Figure 5:
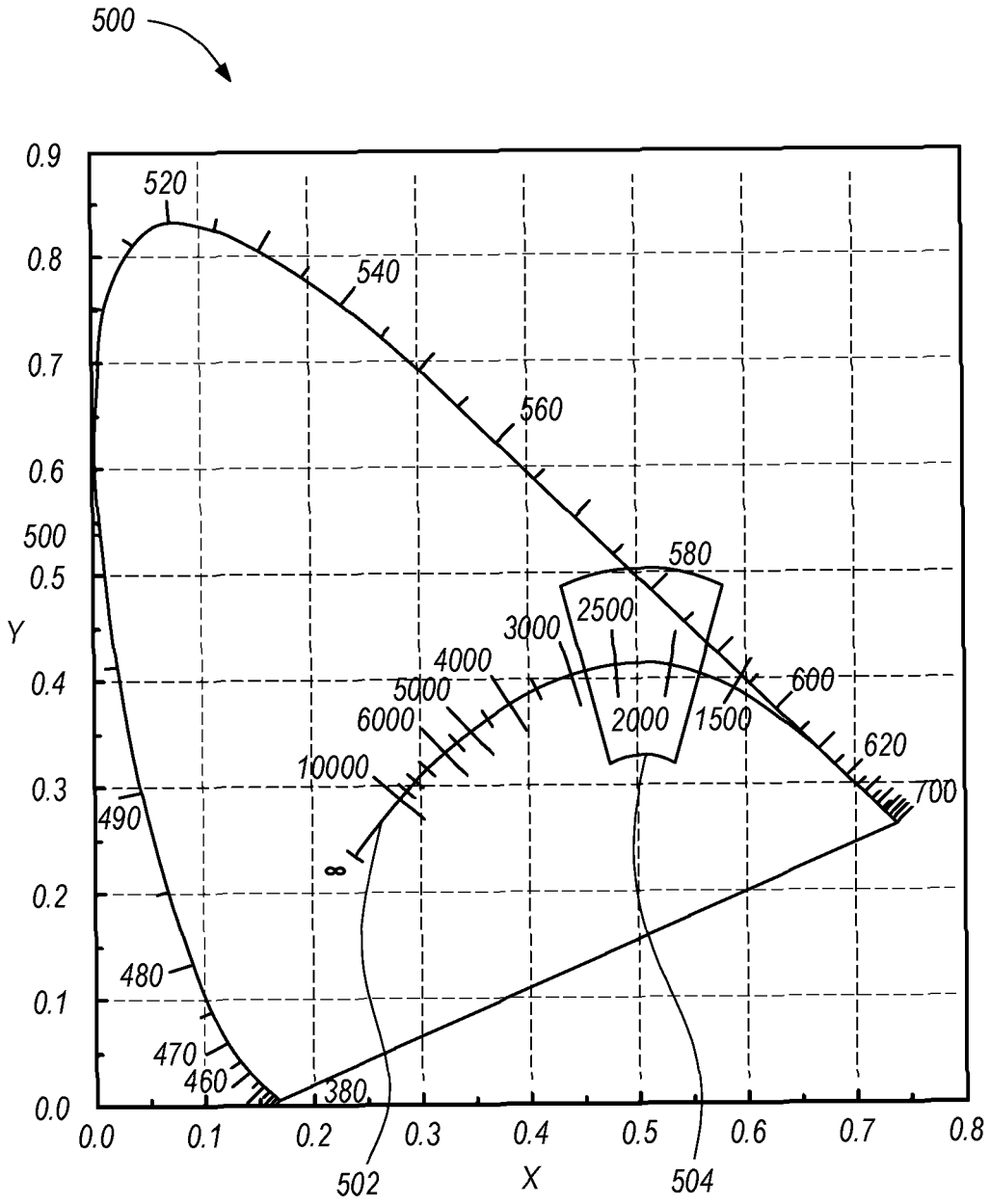
FIG. 5 is CIE 1931 chromaticity diagram illustrating an exemplary preferred operating color temperature range.

The various LED-based luminaire embodiments described above are designed to simulate the color-warming effect that naturally occurs when dimming an incandescent filament-based luminaire. FIG. 5 shows a standard CIE 1931 chromaticity diagram. A black body curve 502 approximates the change in color of a black body (e.g., a bulb filament) as the temperature of the black body changes. The region 504 illustrates the preferred region of output chromaticities during dimming for a luminaire according to the present invention. In one embodiment, the luminaire produces light near 2700K when the luminaire is at full power, and near 1800K when the luminaire is fully dimmed (e.g., 25 or 15 percent illumination). In one embodiment, the luminaire produces light near 3000K when the luminaire is at full power, and near 2000K when the luminaire is fully dimmed. Preferably, as the luminaire dims, the color of emitted light remains within 3 SDCM (Standard Deviation Color Matching, i.e., MacAdam Ellipses) of the black body curve. Ideally, the emitted light should not exceed 1 SDCM above or 2 SDCM below the black body curve, as illustrated by the region 504.

In order to produce the color temperatures described above, a power supply with a dimming control alters the electromagnetic radiation output from one of the two pluralities LEDs of the luminaire. For example, where there luminaire includes both blue and warm white LEDs, the warm white LEDs will remain on at full strength regardless of any dimming signal, whereas the blue LEDs will lower in brightness according to the dimming signal. The overall effect is that total output light becomes warmer as it becomes less bright. Because only one set of LEDs is changing brightness, the power supply circuitry required for the dimming function may be simplified.

Figure 6:
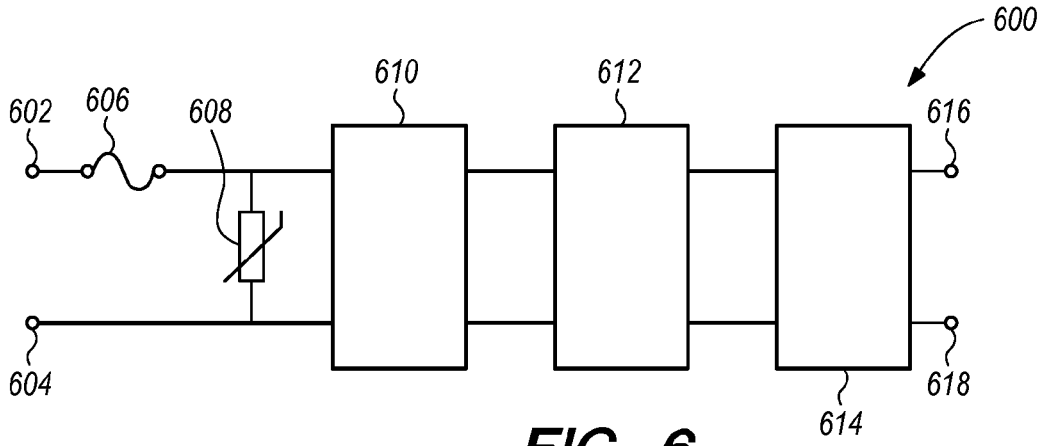
FIG. 6 is a schematic diagram of an exemplary power conditioning circuit.

FIG. 6 illustrates an exemplary power conditioning circuit 600 for conditioning an AC power signal for use in an LED luminaire. The circuit 600 includes a line input 602 and a neutral input 604 both connectable to an AC power source, for example mains power. A fuse 606 is connected in series with the line input 602. The fuse 606 protects LEDs and other circuit components from overvoltage and may be of any suitable type. An Metal Oxide Varistor (MOV) 608 connected between the lines from inputs 602 and 604, after the fuse 606, adds further overvoltage protection.

A first electro-magnetic interference (EMI) filter 610 is connected to the lines from inputs 602 and 604. The EMI filter 610 may reduce high frequency or other interference from the power source connected to inputs 602 and 604. The first EMI filter 610 is in turn connected to bridge rectifier 612. The bridge rectifier 612 may be a half-wave or full-wave rectifier. In some embodiments, a second EMI filter 614 is connected to the output of the bridge rectifier 612 to remove lingering AC frequency harmonics. The power conditioning circuit 600 has two output terminals 616 and 618.

Figure 7:
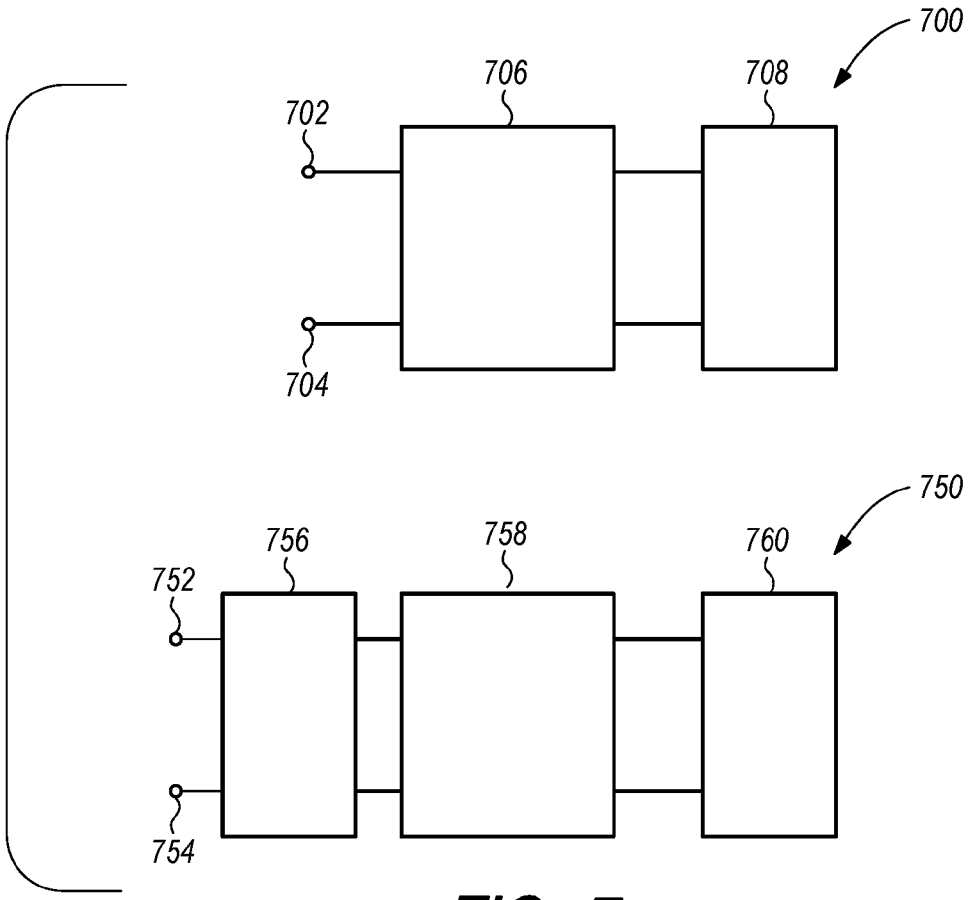
FIG. 7 is a schematic diagram of an exemplary bifurcated power supply circuit.

FIG. 7 illustrates an exemplary bifurcated power supply circuit for warm dimming LEDs according to the present invention. A first power supply unit 700 includes inputs 702 and 704 that are connected to the outputs 616 and 618, respectively, of the power conditioning unit 600. The inputs 702 and 704 are in turn connected to a typical dimmable LED driver 706, for example Power Integrations' LYTSwitch-4 Single-Stage Accurate Primary-Side Constant Current Controller. The dimmable LED driver 706 may be isolated or non-isolated. The dimmable LED driver 706 is connected to a first LED load 708, which could include the first plurality of LEDs described earlier (e.g., blue LEDs). Thus, when a dimming power signal is received at the LED driver 706, the LEDs of the LED load 708 will dim accordingly.

A dimming signal may produced by a wall-dimmer switch connected to mains power, or any other suitable dimming unit. The dimmable LED driver 706 is designed to react to a detection that the power signal from input 702 has been altered to provide less than the nominal power signal. In one embodiment the dimmable LED driver 706 detects that the power signal from input 702 has less than nominal amplitude. In one embodiment the dimmable LED driver 706 detects that the power signal has been forward phase altered (forward phase control) for forward phase dimming. In one embodiment the dimmable LED driver 706 detects that the power signal has been reverse phase altered (reverse phase control) for reverse phase dimming. In one embodiment the LED driver 706 is capable of detecting any or all of the above signal alterations.

A second power supply unit 750 includes inputs 752 and 754 that are connected to the outputs 616 and 618, respectively, of the power conditioning unit 600. The inputs 752 and 754 are connected to a font-end capacitor block 756 which is in turn connected to a non-dimmable switched-mode power supply (SMPS) 758. In some embodiments the SMPS 758 is a Buck converter. In some embodiments the SMPS 758 is a Boost converter, and in some embodiments it is a Buck-Boost converter. In some embodiments the SMPS 758 is a constant current converter and in some embodiments it is a constant voltage converter. The SMPS 758 is connected to a second LED load 760, which could include the second plurality of LEDs described earlier (e.g., warm white LEDs).

Figure 8:
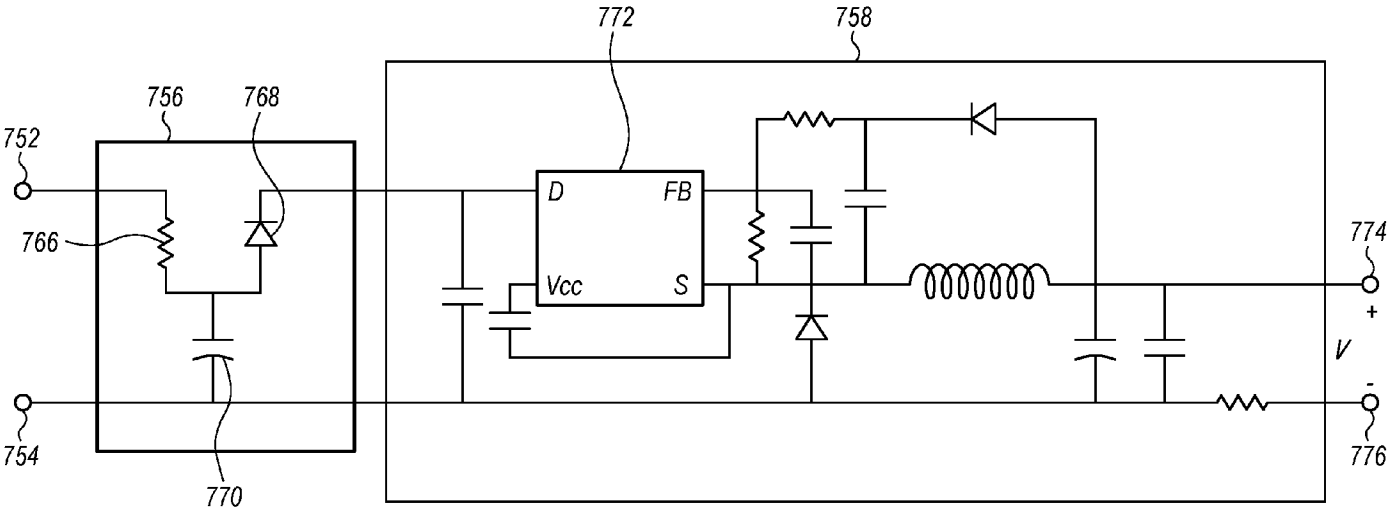
FIG. 8 is a circuit diagram of an exemplary control unit of the bifurcated power supply circuit of FIG. 7.

FIG. 8 illustrates an exemplary embodiment of the power supply unit 750, including capacitor block 756 and SMPS 758. The capacitor block includes a resistor 766 and diode 768 connected in series on the line wire connected to input 752. An electrolytic capacitor 770 is connected from the line wire, between the resistor 766 and diode 768, to the ground wire connected to input 754. The SMPS 758, as illustrated, is a buck converter. Among other components, the SMPS 758 includes power switch integrated circuit (IC) 772. Exemplary power switch ICs include, for example, Power Integrations' LinkSwitch™-TN family ICs. The voltage v between the outputs 774 and 776 determines the brightness of the second LED load 760.

The second power supply unit 750 of the above embodiments has no dim-detecting circuitry. Sizing the capacitor block 756 correctly allows the SMPS 758 to provide a near constant power to the second LED load 760 over the active range of the dimming signal. Tuning the values of the capacitor block 756, allows for the SMPS 758 output power to decrease when the duty cycle of the input power signal falls below a threshold value.

Figure 9:
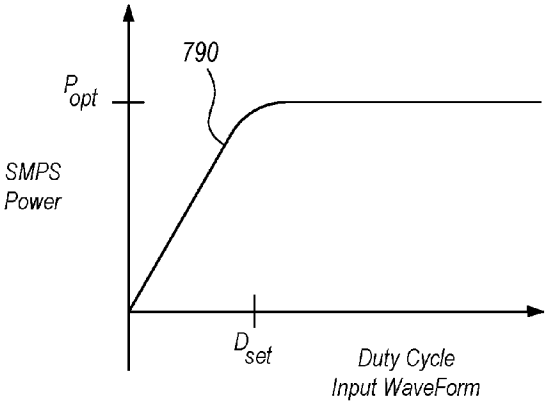
FIG. 9 is a plot illustrating a duty cycle input waveform versus power supply output curve for an exemplary power supply circuit.

FIG. 9 illustrates an exemplary plot of SMPS 758 power output versus duty cycle input waveform when utilizing capacitor block 756. The SMPS 758 power is constant at $P_{opt}$ until the duty cycle of the input signal falls below the threshold point $D_{set}$. As the duty cycle continues to fall from $D_{set}$ to 0 percent, the SMPS 758 output power also decreases, resulting in decreased brightness from the second LED load 760. While the correlation between the duty cycle and the output power at low duty cycles is illustrated in FIG. 9 as a line 790, the correlation need not be linear. The components of the capacitor block 756 may control the relationship between duty cycle and power output as well as the value of $D_{set}$.

Figure 10:
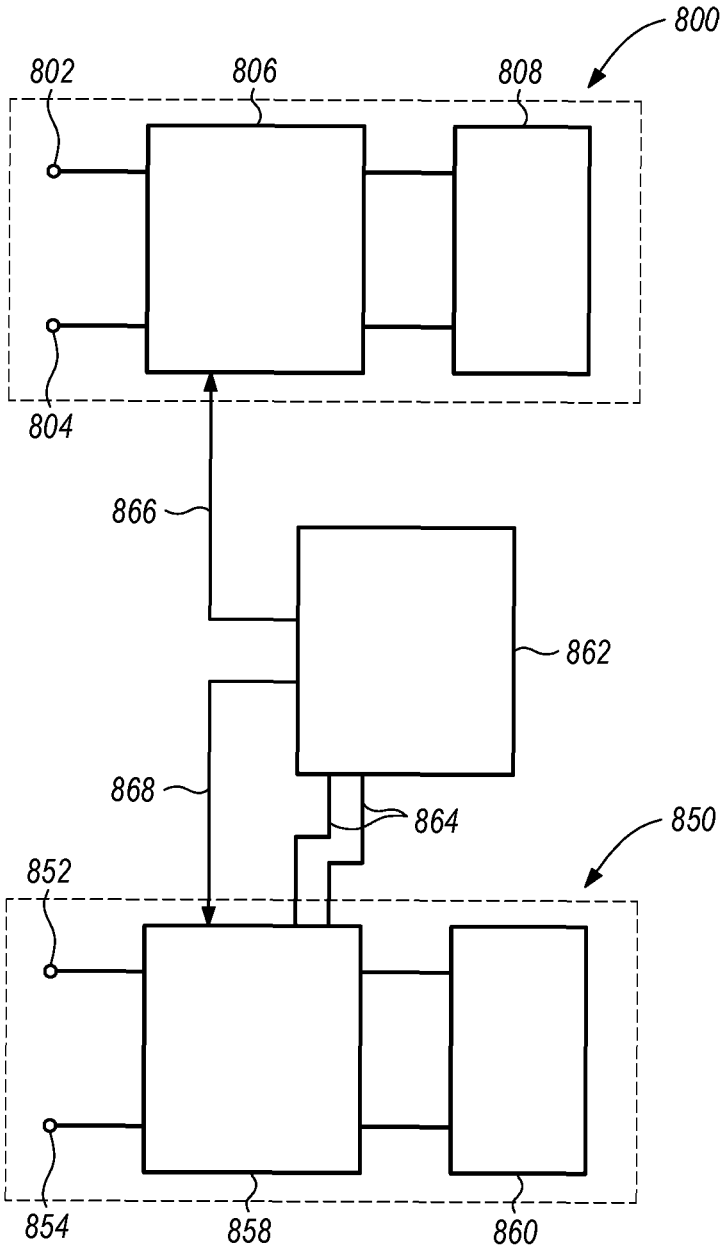
FIG. 10 is a schematic diagram of an exemplary bifurcated power supply circuit with a dimming receiver module.

FIG. 10 illustrates an exemplary embodiment of a bifurcated power supply circuit that utilizes a dimming receiver module. A first power supply unit 800 includes inputs 802 and 804 that are connected to the outputs 616 and 618, respectively, of the power conditioning unit 600. The inputs 802 and 804 are in turn connected to a typical dimmable LED driver 806, as described earlier. The dimmable LED driver 806 is connected to a first LED load 808. A second power supply unit 850 includes inputs 852 and 854 that are connected to the outputs 616 and 618, respectively, of the power conditioning unit 600. The inputs 852 and 854 are connected to a non-dimmable switched-mode power supply (SMPS) 858. The SMPS 858 is connected to a second LED load 860.

A dimming receiver module 862 receives a dimming signal for controlling the brightness of the LED loads 808 and 860. In one embodiment the dimming receiver module 862 is configured to receive wireless communication through a wireless protocol such as, for example, Bluetooth, WiFi, RFID or optical (e.g., infrared), and may include an antenna or sensor (not shown) for receiving wireless signals. In one embodiment the dimming receiver module 862 is configured to receive wired communication through a wired protocol such as, for example, Ethernet, USB, Firewire or the like. The signal may be digital and the data relating to dimming contained in one or more data packets. The dimming receiver module 862 may include a processor and a memory (not shown) for storing dimming information, for example to return the LEDs to a previous brightness level when power is restored to the system.

In one embodiment the dimming receiver module 862 is powered via power inputs 864 from SMPS 858. In one embodiment the dimming receiver module 862 is powered from the dimmable LED driver 806. In one embodiment the dimming receiver module 862 includes its own power regulation circuitry and is powered directly from mains power or another power source (e.g., one or more batteries or a wired communication connection).

The dimming receiver module 862 includes a first control output 866 that is in circuit connection with the dimmable LED driver 806. In one embodiment the output signal of the first control output 866 approximates the output of a dimmer-wall switch based upon a wireless dimmer signal received by the dimming receiver module 862. In one embodiment the wireless module 862 outputs a pulse-width modulated (PWM) signal.

In one embodiment the dimming receiver module 862 also includes a second control output 868 that is in circuit connection with SMPS 858. The second control output 868 may send a signal to the SMPS 858 causing SMPS 858 power output to diminish when a low-enough dimming signal is received by the wireless module 862.

Figure 11:
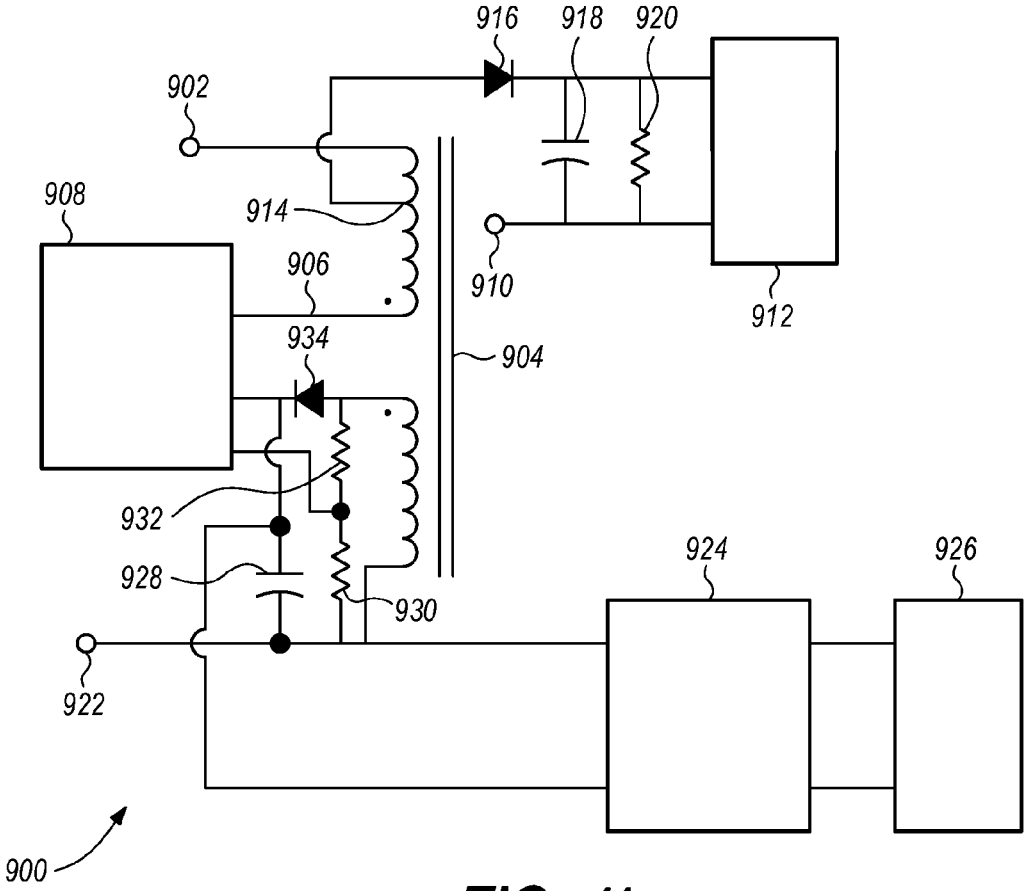
FIG. 11 is a circuit diagram of an exemplary constant current power supply circuit.

FIG. 11 illustrates an exemplary embodiment of a constant current power supply circuit 900 for warm dimming LEDs according to the present invention. The constant current power supply circuit 900 varies output voltage to maintain a constant current output to the LEDs. A first input 902 is connected to the output 616 of the power conditioning unit 600. The first input 902 is in turn connected to one end of a primary winding of an iron-core transformer 904. The opposing end of the primary winding of transformer 904 is connected to the gate 906 of a constant current LED driver circuit 908. The constant current LED driver circuit 908 may be as described for previous embodiments. In one embodiment the gate 906 includes a current sensing element. A second input 910 is also connected to the output 616 of the power conditioning unit 600. The input 910 is directly connected to a first LED load 912. A center tap 914 off the secondary winding transformer 904 is also connected to the first LED load 912 through diode 914. Electrolytic capacitor 918 and resistor 920 are connected in parallel between the diode 914 and the second input 910.

A third input 922 is connected to the output 618 of the power conditioning unit 600. The third input 922 is directly connected to a regulator 924. The regulator 924 may be a current regulator, voltage regulator, or switching converter. The regulator 924 feeds power to a second LED load 926. The constant current LED driver circuit 908 is also connected to the connection between the third input 922 and regulator 924 via electrolytic capacitor 928. The second winding of transformer 904, in parallel with resistors 930 and 932, feeds back from regulator 924 to the constant current LED driver circuit 908 through diode 934.

Figure 12:
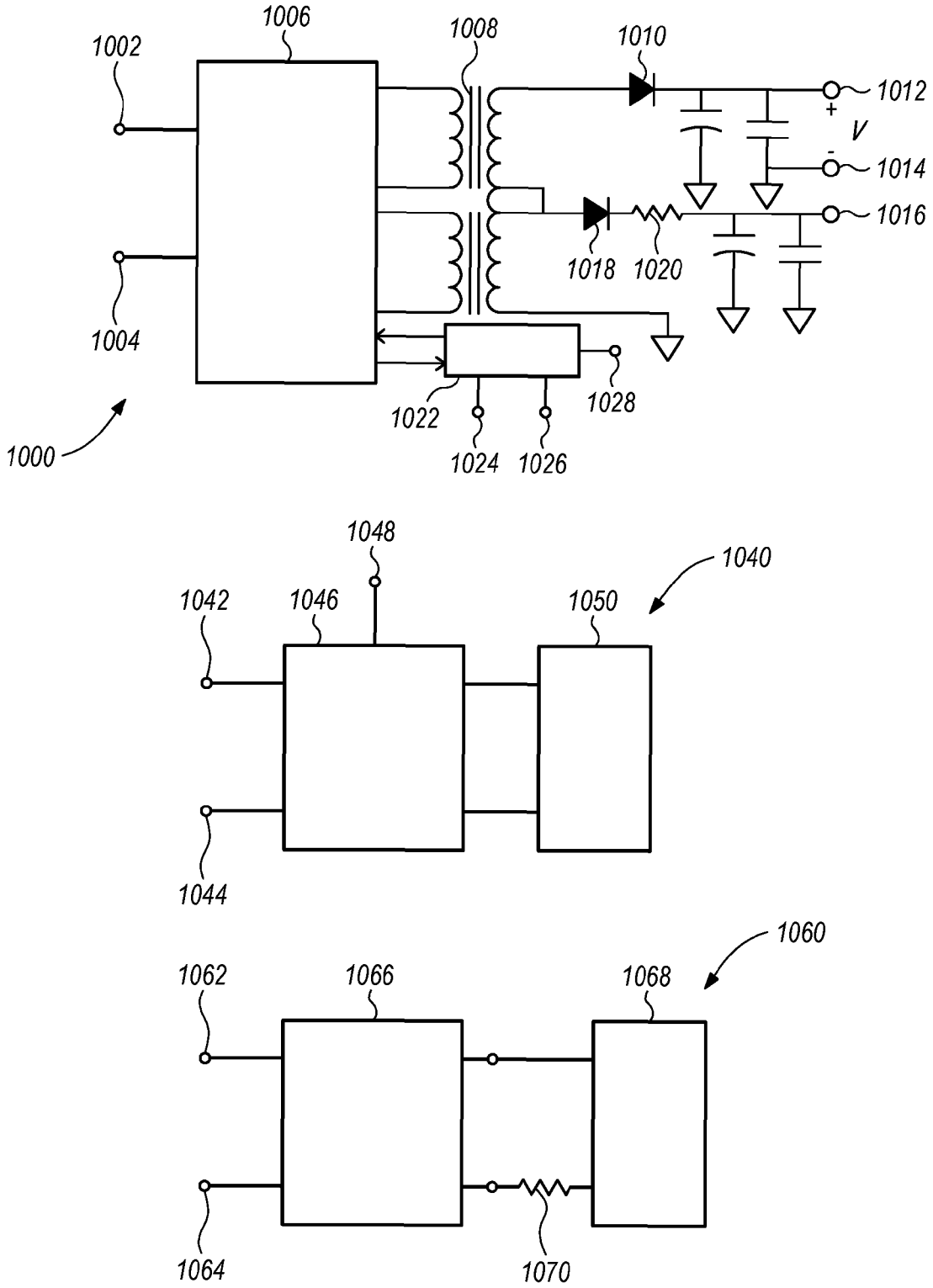
FIG. 12 is a circuit diagram of an exemplary constant voltage power supply circuit.

FIG. 12 illustrates an exemplary constant voltage power supply circuit for warm dimming LEDs according to the present invention. A power input unit 1000 includes inputs 1002 and 1004 that are connected to the outputs 616 and 618, respectively, of the power conditioning unit 600. The inputs 1002 and 1004 are in turn connected to an SMPS 1006, which may be of the type described for earlier embodiments. The SMPS 1006 is connected to a pair of primary windings in an iron-core transformer 1008. One end of the second winding of transformer 1008 is connected to ground. The other end of the secondary winding is connected through diode 1010 to a first output 1012. A second output 1014 is connected to ground. One or more filtering capacitors, electrolytic or non-polar, may be connected between the first output 1012 and ground. A center tap off the secondary winding of transformer 1008 is connected to a third output through diode 1018 and resistance 1020. One or more filtering capacitors, electrolytic or non-polar, may be connected between the third output 1016 and ground.

A feedback loop and compensation circuit 1022 may be bidirectionally connected to SMPS 1006. The feedback loop and compensation circuit 1022 includes inputs 1024 and 1026 connected to outputs 1012 and 1016 respectively. Additionally, feedback loop and compensation circuit 1022 may include an output 1028, which is configured to produce a dimming signal. Feedback loop and compensation circuit 1022 limits the current output to prevent damage to the LEDs.

A first control unit 1040 includes inputs 1042 and 1044 connected to outputs 1012 and 1014 respectively of the power input unit 1000. The inputs 1042 and 1044 are connected to a constant current LED driver 1046, which may be as described in previous embodiments. The constant current LED driver 1046 may also include input 1048 for receiving a dimming signal. The constant current LED driver 1046 is connected to a first LED load 1050 for controlling power to that load based on the input power and/or dimming signal.

A second control unit 1060 has inputs 1062 and 1064, also connected to outputs 1012 and 1014 respectively of the power input unit 1000. In one embodiment the inputs 1062 and 1064 are connected to conditioning circuitry 1066, which reduces ripple. The conditioning circuitry 1066 may be, for example, a current regulator, voltage regulator, switching converter or the like, and may improve performance of the second LED load 1068 connected to conditioning circuitry 1066. In one embodiment, for example if the conditioning circuitry 1066 is a switching converter, a resistance or feedback loop 1070 limits the current output to prevent damage to the LEDs. In one embodiment, for example if the conditioning circuitry 1066 is a current regulator, the resistance 1070 is zero. In one embodiment the second LED load 1068 is directly connected to inputs 1062 and 1064 without any conditioning circuitry.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and/or illustrative examples shown and described. Accordingly, departures may be made from such details without departing from the spirit or scope of the applicants' general inventive concept.

We claim:

1. A power supply for powering a first plurality of LEDs via a first output and a second plurality of LEDs via a second output, comprising:

an input portion accepting an electrical power signal from an external source;

a dimming portion;

a fixed power supply portion generating the second output an fixed electrical signal that will cause the second plurality of LEDs to have a fixed illumination over a preselected range responsive to changes in a dimming signal from the dimming portion; and a variable power supply portion generating at the first output a variable electrical signal that will cause the first plurality of LEDs to have a variable illumination responsive to changes in the signal from the dimming portion while the fixed power supply portion generates at the second output the fixed electrical signal.

2. The power supply according to claim 1, wherein the variable power supply portion generates a variable electrical signal that varies current provided to the first output over a range of at least 75% to 25% responsive to changes in the signal from the dimming portion while the fixed power supply portion generates at the second output a fixed current electrical signal.

3. The power supply according to claim 1, wherein the variable power supply portion generates a variable electrical signal that varies current provided to the first output over a range of at least 99% to 15% responsive to changes in the signal from the dimming portion while the fixed power supply portion generates at the second output a fixed current electrical signal.

4. The power supply according to claim 1, wherein the dimming portion determines that the variable electrical signal at the first output is to be changed while the fixed current electrical signal at the second output using at least one of the following characteristics of the electrical power signal from the external source:

(a) detecting that the electrical power signal has less than nominal amplitude;

(b) detecting that the electrical power signal has been forward phase altered (forward phase control) for forward phase dimming;

(c) detecting that the electrical power signal has been reverse phase altered (reverse phase control) for reverse phase dimming; and (d) detecting that the electrical power signal has been otherwise altered to provide something other than the nominal power signal.

5. The power supply according to claim 2, wherein the dimming portion determines that the variable electrical signal at the first output is to be changed while the fixed current electrical signal at the second output using at least one of the following characteristics of the electrical power signal from the external source:

(a) detecting that the electrical power signal has less than nominal amplitude;

(b) detecting that the electrical power signal has been forward phase altered (forward phase control) for forward phase dimming;

(c) detecting that the electrical power signal has been reverse phase altered (reverse phase control) for reverse phase dimming; and (d) detecting that the electrical power signal has been otherwise altered to provide something other than the nominal power signal.

6. The power supply according to claim 3, wherein the dimming portion determines that the variable electrical signal at the first output is to be changed while the fixed current electrical signal at the second output using at least one of the following characteristics of the electrical power signal from the external source:

(a) detecting that the electrical power signal has less than nominal amplitude;

(b) detecting that the electrical power signal has been forward phase altered (forward phase control) for forward phase dimming;

(c) detecting that the electrical power signal has been reverse phase altered (reverse phase control) for reverse phase dimming; and (d) detecting that the electrical power signal has been otherwise altered to provide something other than the nominal power signal.

7. The power supply according to claim 1, wherein the dimming portion determines that the variable electrical signal at the first output is to be changed via a received dimming signal that is other than a modified electrical power signal from the external source.

8. The power supply according to claim 1, wherein the power supply further comprises a wireless receiver and further wherein the dimming portion determines that the variable electrical signal at the first output is to be changed via a received wireless dimming signal.

9. The power supply according to claim 2, wherein the power supply further comprises a wireless receiver and further wherein the dimming portion determines that the variable electrical signal at the first output is to be changed via a received wireless dimming signal.

10. The power supply according to claim 3, wherein the power supply further comprises a wireless receiver and further wherein the dimming portion determines that the variable electrical signal at the first output is to be changed via a received wireless dimming signal.

11. The power supply according to claim 1, wherein the fixed power supply portion generates the fixed electrical signal at the second output responsive to changes in a dimming signal from the dimming portion until a point where the variable power supply portion turns off the variable electrical signal at the first output, at which time the fixed power supply portion turns off the fixed electrical signal at the second output.

12. The power supply according to claim 2, wherein the fixed power supply portion generates the fixed electrical signal at the second output responsive to changes in a dimming signal from the dimming portion until a point where the variable power supply portion turns off the variable electrical signal at the first output, at which time the fixed power supply portion turns off the fixed electrical signal at the second output.

13. The power supply according to claim 3, wherein the fixed power supply portion generates the fixed electrical signal at the second output responsive to changes in a dimming signal from the dimming portion until a point where the variable power supply portion turns off the variable electrical signal at the first output, at which time the fixed power supply portion turns off the fixed electrical signal at the second output.

14. The power supply according to claim 4, wherein the fixed power supply portion generates the fixed electrical signal at the second output responsive to changes in a dimming signal from the dimming portion until a point where the variable power supply portion turns off the variable electrical signal at the first output, at which time the fixed power supply portion turns off the fixed electrical signal at the second output.

15. The power supply according to claim 7, wherein the fixed power supply portion generates the fixed electrical signal at the second output responsive to changes in a dimming signal from the dimming portion until a point where the variable power supply portion turns off the variable electrical signal at the first output, at which time the fixed power supply portion turns off the fixed electrical signal at the second output.

16. The power supply according to claim 1, wherein the fixed power supply portion generates a constant current electrical signal at the second output responsive to changes in a dimming signal from the dimming portion until a point where the variable power supply portion turns off the variable electrical signal at the first output, at which time the fixed power supply portion turns off the fixed electrical signal at the second output.

17. The power supply according to claim 2, wherein the fixed power supply portion generates a constant current electrical signal at the second output responsive to changes in a dimming signal from the dimming portion until a point where the variable power supply portion turns off the variable electrical signal at the first output, at which time the fixed power supply portion turns off the fixed electrical signal at the second output.

18. The power supply according to claim 3, wherein the fixed power supply portion generates a constant current electrical signal at the second output responsive to changes in a dimming signal from the dimming portion until a point where the variable power supply portion turns off the variable electrical signal at the first output, at which time the fixed power supply portion turns off the fixed electrical signal at the second output.

19. The power supply according to claim 4, wherein the fixed power supply portion generates a constant current electrical signal at the second output responsive to changes in a dimming signal from the dimming portion until a point where the variable power supply portion turns off the variable electrical signal at the first output, at which time the fixed power supply portion turns off the fixed electrical signal at the second output.

20. The power supply according to claim 7, wherein the fixed power supply portion generates a constant current electrical signal at the second output responsive to changes in a dimming signal from the dimming portion until a point where the variable power supply portion turns off the variable electrical signal at the first output, at which time the fixed power supply portion turns off the fixed electrical signal at the second output.

* * * * *